United States Patent [19]

Itou et al.

[11] Patent Number: 5,045,750

[45] Date of Patent: Sep. 3, 1991

[54] COLOR PICTURE TUBE HAVING A PHOSPHOR SCREEN WITH A SEMITRANSPARENT BLACK LIGHT ABSORPTION

[75] Inventors: Takeo Itou, Kumagaya; Hidemi Matsuda, Oomiya; Kazuhiko Shimizu, Fukaya; Hajime Tanaka, Fujioka, all of Japan

[73] Assignee: Kabushiki Kaisha Toshiba, Kawasaki, Japan

[21] Appl. No.: 557,066

[22] Filed: Jul. 25, 1990

[30] Foreign Application Priority Data

Jul. 27, 1989 [JP] Japan ..... 1-195211

[51] Int. Cl.[5] ..... H01J 29/10; H01J 29/30

[52] U.S. Cl. ..... 313/466; 313/461; 313/470

[58] Field of Search ..... 313/466, 461, 470

[56] References Cited

U.S. PATENT DOCUMENTS 4,720,655 1/1988 Hinotani et al. ..... 313/466

FOREIGN PATENT DOCUMENTS 52-74274 6/1977 Japan .
0010658 1/1979 Japan ..... 313/466
0012259 1/1979 Japan ..... 313/466
0038741 4/1981 Japan ..... 313/466

*Primary Examiner*—Donald J. Yusko
*Assistant Examiner*—Nimeshkumar D. Patel
*Attorney, Agent, or Firm*—Cushman, Darby & Cushman

[57] ABSTRACT

A color picture tube includes a vacuum envelope having a faceplate, a phosphor screen formed to include semitransparent black light-absorption layers coated on a first region of the faceplate in stripes or in a matrix, and phosphor layers of blue, red and green emitting phosphors coated on a second region of the faceplate in stripes or in dots, and an electron gun, arranged within the vacuum envelope, for emitting and focusing electron beams. End portions of the phosphor layers extend over the black light-absorption layers, thereby forming overlapped portions. Gaps are provided between the phosphor layers and over the black light-absorption layers, thereby forming light-absorption sections on which no phosphor layer is provided.

4 Claims, 3 Drawing Sheets

COLOR PICTURE TUBE HAVING A PHOSPHOR SCREEN WITH A SEMITRANSPARENT BLACK LIGHT ABSORPTION

BACKGROUND OF THE INVENTION

1. Field of the Invention

The present invention relates generally to a color picture tube, and more particularly to an improvement of a phosphor screen of the color picture tube.

2. Description of the Related Art

A color picture tube generally comprises a faceplate having an inner surface provided with a phosphor screen; a vacuum envelope made of glass including a funnel connected integrally with the faceplate; and an electron gun for emitting electron beams, which is housed in a neck of the funnel.

As is shown in FIG. 1, a phosphor screen 7 comprises black light-absorption layers 14 made mainly of carbon, and phosphor layers 13B, 13G and 13R capable of emitting blue, green and red light. The light-absorption layers 14 are formed on a faceplate 2 in stripes or in a matrix. The phosphor layers 13B, 13G and 13R are formed over the light-absorption layers 14, similarly in stripes or in dots arranged in a matrix.

As has been stated above, in a widely used color picture tube, the three color phosphor layers 13B, 13G and 13R are formed in stripes or in dots, and the black light-absorption layers 14 are formed between the stripes of these phosphor layers 13B, 13G and 13R ("black stripe type color picture tube") or formed between the dots of the phosphor layers 13B, 13G and 13R ("black matrix type color picture tube"). The black light-absorption layers 14 are employed to enhance the contrast of images. Specifically, the layers 14 prevent light reflection, and absorb light in the vicinity of phosphor layers 13B, 13G and 13R where mislanding of electron beams is likely to occur.

In the black stripe type or black matrix type color picture tube, the contrast of images is enhanced by the light-absorption layers, but the improvement of luminance of images is limited. Published Unexamined Japanese Patent Application No. 52-74274 discloses a technique of improving the luminance, wherein the black light-absorption layers 14 with a light transmittance of 5 to 40% (i.e. "semitransparent") are employed thereby remarkably increasing the luminance.

The black light-absorption layers, however, function also as so-called guard band portions for absorbing mislanded electron beams. Thus, if the light-absorption layers are simply made semitransparent, the color purity and landing characteristics are deteriorated. Thus, this technique is disadvantageous in practical use.

SUMMARY OF THE INVENTION

The present invention has been made in consideration of the above problems, and its object is to provide a color picture tube having a phosphor screen capable of remarkably enhancing luminance and contrast, while preventing degradation of color purity and landing characteristics.

According to the present invention, there is provided a color picture tube comprising: a vacuum envelope having a faceplate; a phosphor screen formed such that semitransparent black light-absorption layers are coated on a first region of said faceplate in stripes or in a matrix, and phosphor layers of blue, red and green emitting phosphors are coated on a second region of said faceplate in stripes or in dots; and an electron gun, arranged within the vacuum envelope, for emitting and focusing electron beams, wherein end portions of said phosphor layers extend over the black light-absorption layers respectively, thereby forming overlapped portions, and gaps are provided between the phosphor layers and on the black light-absorption layers, thereby forming light-absorption sections on which no phosphor layer is provided.

The phosphor screen comprises semitransparent black light-absorption layers formed on the first region of the face plate, the overlapped portions formed by allowing the phosphor layer to extend over the black light-absorption layer, the light-absorption section formed at a predetermined gap between adjacent overlapped portions, and the phosphor layers formed on the second region of the faceplate. When the overlapped portions are hit by electron beams, the phosphor in the overlapped portions are excited to emit light, and a portion of the emitted light transmits through the semitransparent black light-absorption layer. By virtue of the black light-absorption layer in the overlapped portion, the degradation of color purity due to mislanding of electron beam can be prevented to some degree. Since the black light-absorption layer is semitransparent, the luminance can be more enhanced than in the case of using an opaque black light-absorption layer. Since no phosphor layer is provided on the light-absorption section, this section emits no light even if it is irradiated by electron beams. Therefore, the light-absorption section can effectively prevent the degradation of color purity due to mislanding of electron beam.

The first region of the faceplate is the region where the black light-absorption layers are to be formed in stripes or in a matrix, and the second region thereof is the region excluding the first region, where the phosphor layers are to be formed in stripes or in dots.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 2:
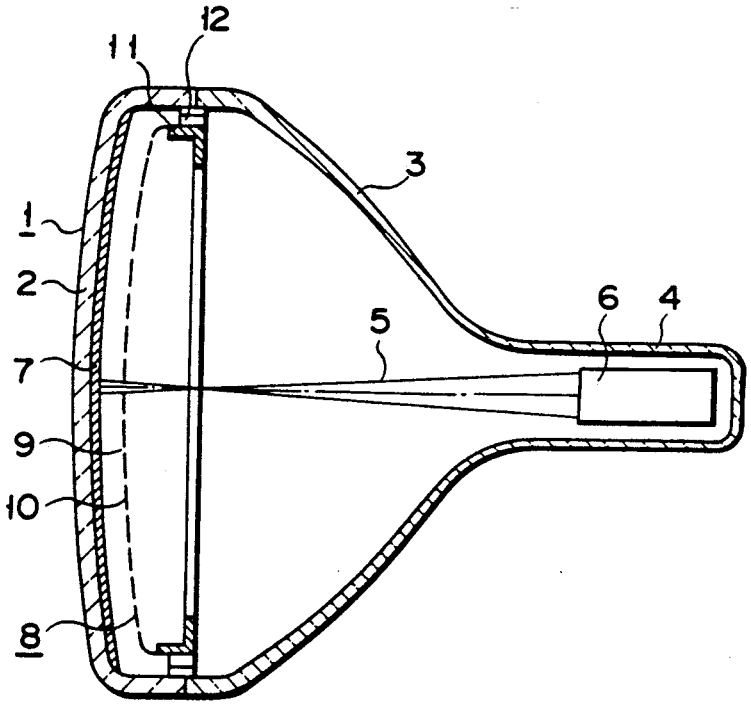
FIG. 2 is a cross-sectional view showing a color picture tube according to an embodiment of the present invention.

FIG. 2 shows a color picture tube according to one embodiment of the present invention. As is shown in FIG. 2, a vacuum envelope 1 made of glass is constituted such that a faceplate 2 is integrally connected to a funnel 3. The funnel 3 is provided with a neck portion 4. An electron gun 6 for emitting and focusing electron beams 5 is arranged within the neck 4. A phosphor screen 7 is formed on the inner surface of the faceplate 2 of the envelope 1, such that the phosphor screen 7 opposes the electron gun 6. A shadow mask structure 8 is arranged on the inside of the phosphor screen 7. The shadow mask structure 8 comprises a shadow mask 10 having a number of electron beam passing holes 9 through which the electron beams 5 emitted from the electron gun 6 pass; a rectangular mask frame 11 having a front face on which the shadow mask 10 is fixed; and a frame support 12 secured to the outside of the four sides of mask frame 11. The frame support 12 is engaged with pins (not shown) projecting from the inner wall of the faceplate 2, whereby the mask frame 11 is held with the envelope 1. The shadow mask 10 is situated oppositely close to the phosphor screen 7, with a predetermined distance therebetween. Though not shown, a deflecting yoke for deflecting and scanning the electron beams 5 is mounted on an outer wall of the funnel 3 and neck portion 4.

In this type of color picture tube, the electron beams 5 emitted from the electron gun 6 pass through the holes 9 formed in the shadow mask 10, and impinge upon the phosphor screen 7 on the inner surface of the faceplate 2 opposing the shadow mask 10, i.e. upon phosphor layers 13B, 13G and 13R capable of emitting blue, green and red light. Thus, the phosphor layers 13B, 13G and 13R emit light to form an image.

The above-described color picture tube according to the present invention has the phosphor screen 7, which includes black light-absorption layers formed on a first region of the faceplate in stripes or in a matrix and phosphor layers capable of emitting blue, green and red light formed on a second region of the faceplate in stripes or in dots. In this phosphor screen 7, the black light-absorption layers are formed semitransparent and gaps are provided between adjacent ones of at least a number of phosphor layers. The black light-absorption layers situated at the gaps function as light-absorption sections each having a predetermined width and substantially made of only the black light-absorption layer. End portions of the phosphor layers extend over the black light-absorption layers, thus forming overlapped portions each having a predetermined width.

Figure 3:
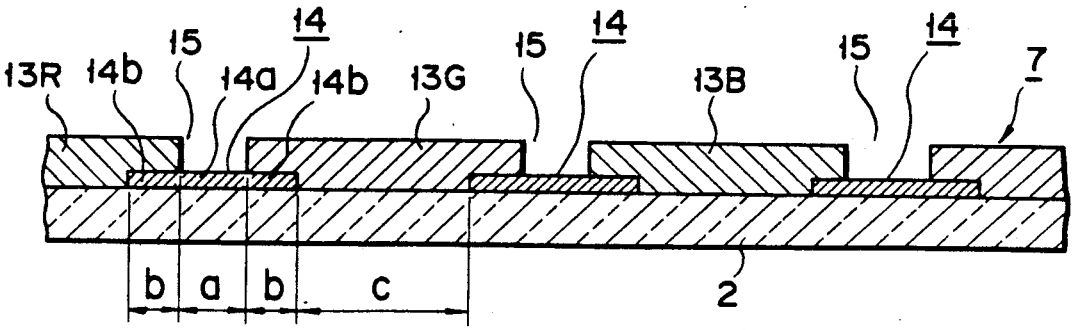
FIG. 3 is a cross-sectional view showing an example of a phosphor screen employed in this invention.

FIG. 3 is a cross-sectional view showing an example of the phosphor screen 7 employed in this invention. Black light-absorption layers 14 formed of a semitransparent material are coated on the first region of the inner surface of the faceplate 2 at regular intervals in stripes or in a matrix. Then, phosphor layers 13B, 13G and 13R capable of emitting blue, green and red light are coated on areas, i.e. the second region of the faceplate, between the black light-absorption layers 14 and on edge portions of the light-absorption layers 14, at regular intervals in stripes or in dots. Specifically, adjacent portions of the phosphor layers 13B, 13G and 13R are not brought into contact with each other, and gaps 15 are provided therebetween. Each semitransparent black light-absorption layer 14 includes a light-absorption section **14*a* formed of only the layer 14 and having a width a, and overlapped portions 14*b* each overlapped with edge portions of the phosphor layers 13B, 13G and 13R** and having a width b.

By virtue of the above structure, the light-absorption section **14*a* of the black light-absorption layer 14 has only a guard band function, and the overlapped portion 14*b* has both a light emission function and a weak guard band function. Since no phosphor layer exists in the gaps between the phosphor layers 13B, 13G and 13R**, where the possibility of mislanding of beams is highest, the color purity is not lowered. Compared to a conventional phosphor screen having semitransparent black light-absorption layers with no gaps, a reliable guard band function is maintained, and the color purity can be increased remarkably.

The overlapped portion **14*b* includes phosphor layer. However, the semitransparent black light-absorption layer 14 in the overlapped portion 14*b* performs a guard band function to some degree, and simultaneously increases luminance. Thus, compared to the prior art shown in FIG. 1**, the luminance can be remarkably enhanced while the color purity is slightly lowered.

Regarding the ratio between the width a of the light-absorption section **14*a* of black light-absorption layer 14, the width b of the overlapped portion 14*b*, and the distance c between adjacent black light-absorption layers 14**, it is desirable to set this ratio such that $c=40$ to 80%, $a=3$ to 50%, and $2 \times b=$ the balance. When a is less than 3%, the guard band function is not performed. When a is above 50%, the luminance is not enhanced effectively.

Figure 4:
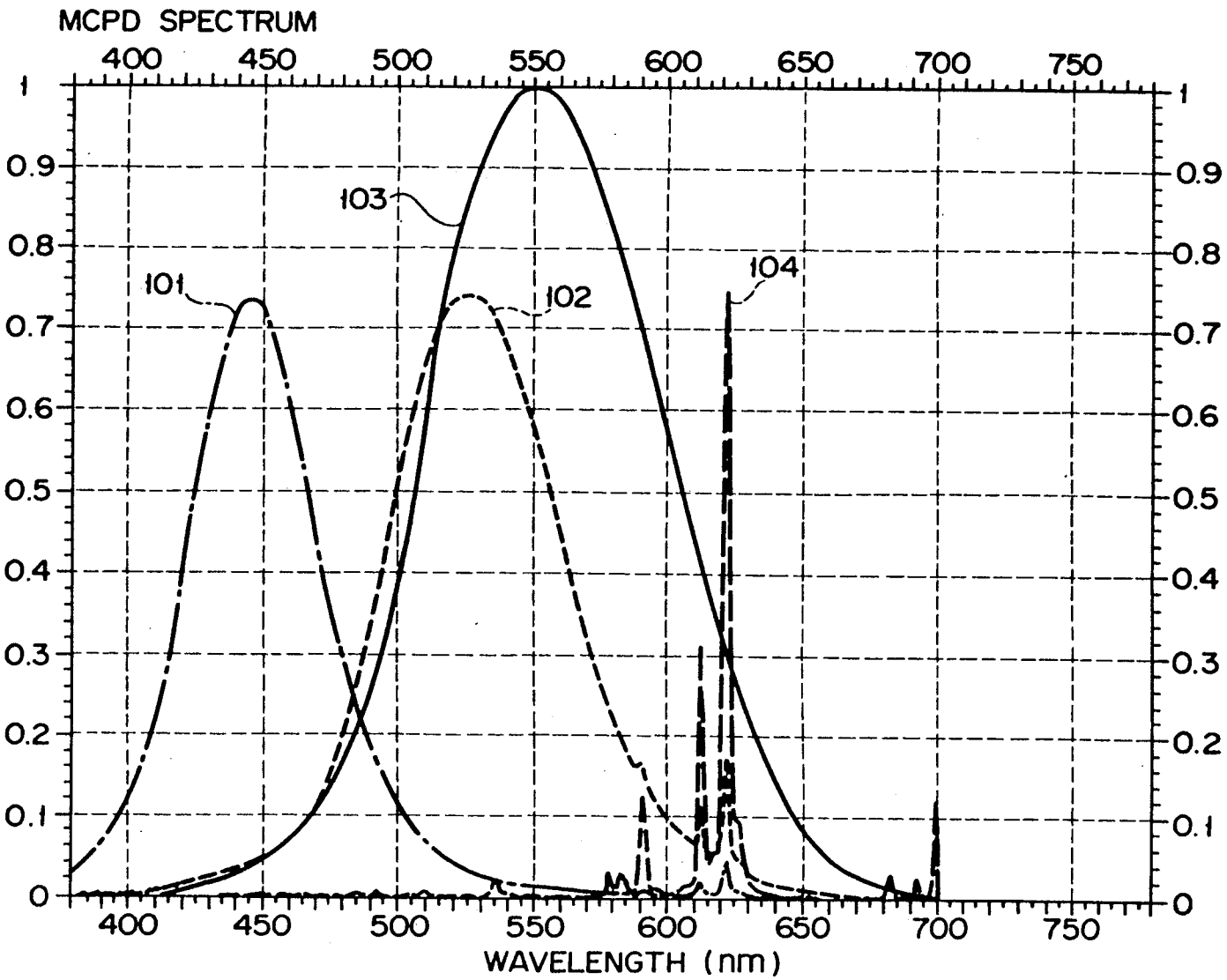
FIG. 4 is a graph showing the relationship between the light-emission spectrum of green emitting phosphor and the visual sensitivity curve.

In practical use, the gaps 15 between phosphor layers 13B, 13G and 13R, and the light-absorption section **14*a* and overlapped portion 14*b* of the black light-absorption layer 14 can be provided only in a peripheral portion or a part of a middle portion of the phosphor screen 7, where sufficient landing characteristics are required. That is, it is not necessary to provide the gaps 15, light-absorption section 14*a* and overlapped portion 14*b* over the entire surface of the phosphor screen 7. In addition, it is possible to provide the gaps 15, light-absorption section 14*a* and overlapped portion 14*b* only in the vicinity of the phosphor layer of one color, e.g. the green emitting phosphor layer 13G where the color purity may considerably be lowered. FIG. 4 shows an emission spectrum of a blue-emitting phosphor (ZnS; Ag, Cl), a green emitting phosphor (ZnS; Cu, Al), a red-emitting phosphor ($Y_2O_2S$; Eu) and a spectral luminous efficiency. As is seen from FIG. 4, the emission spectrum 102 of the green emitting phosphor is close to the spectral luminous efficiency 103, it has a higher luminance at a specific current density, than the emission spectrum 101 of the blue emitting phosphor and emission spectrum 104** of red emitting phosphor. Specifically, the luminance of the green emitting phosphor is about eight times higher than that of the blue emitting phosphor, and is about four times higher than that of the red emitting phosphor. Thus, when a portion of the electron beams emitted to hit the blue emitting phosphor or red emitting phosphor erroneously hits the green emitting phosphor owing to mislanding, the deterioration of color purity is very serious, compared to mislanding of the beam on the blue emitting phosphor or red emitting phosphor. In order to prevent the mislanding of the beam on the green emitting phosphor, it is effective to provide gaps only in the vicinity of the green emitting phosphor. Greater effect is attained by providing larger gaps in the vicinity of the green emitting phosphor, than in the vicinity of the red emitting phosphor or blue emitting phosphor.

According to the phosphor screen of the color picture tube of the present invention, no phosphor layer is formed in the light-absorption section, i.e., in the gap between adjacent phosphor layers, where the possibility of mislanding of beam is highest. Thus, the degradation of color purity can be prevented. The light-absorption section has only a guard band function, while the overlapped portion contributes to light emission and performs a guard band function to some degree. The combination of the light-absorption section and the overlapped portion enables a sufficient guard band function to be maintained, thus enhancing color purity effectively. Since the overlapped portion includes a phosphor layer and a semitransparent black light-absorption layer, it performs a guard band function to some degree and simultaneously increases luminance. As a result, the luminance of image in this invention can be remarkably enhanced.

Examples of the phosphor screen of the present invention will now be described. The light transmissivity of the semitransparent black light-absorption layer 14 was set to 50%. The layer 14 was coated in stripes. The ratio between a, b and c was set, as will be stated below.

EXAMPLE 1

The center portion: c=70%, a=10%, 2b=20%
The peripheral portion: c=50%, a=10%, 2b=40%

EXAMPLE 2

The center portion: c=70%, a=10%, 2b=20%
The peripheral portion: c=50%, a=30%, 2b=20%

EXAMPLE 3

Only in the regions between the green emitting phosphor layer 13G and blue emitting phosphor layer 13B and between the green emitting phosphor layer 13G and red emitting phosphor layer 13R, the ratio was set:

The center portion: c=70%, a=10%, 2b=20%
The peripheral portion: c=50%, a=10%, 2b=40%

Figure 5:
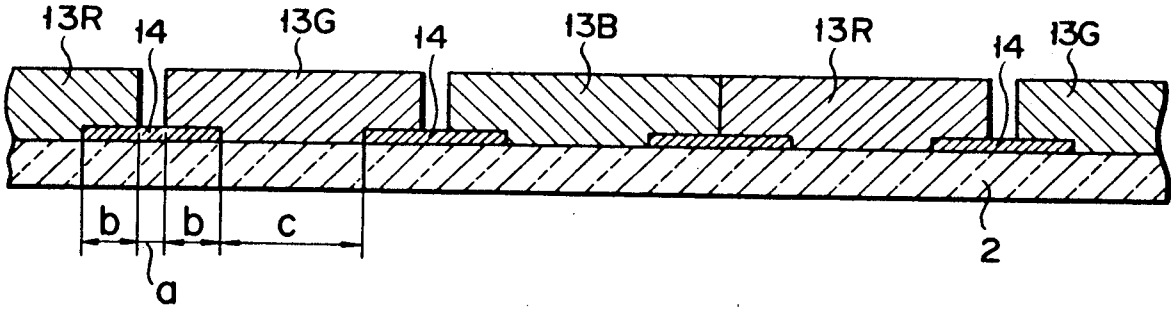
FIGS. 5 and 6 show other examples of the phosphor screen of the present invention.

The distance a between layers 13B and 13R was set to 0. FIG. 5 shows a cross-sectional view of the obtained phosphor screen. As is seen from FIG. 5, the gap a is provided between the green emitting phosphor layer 13G and the red emitting phosphor layer 13R and between the green emitting phosphor layer 13G and the blue emitting phosphor layer 13B. The light-absorption layer includes the light-absorption section having the distance a and the overlapped portion having the width b. However, no gap is provided between the red emitting phosphor layer 13R and the blue emitting phosphor layer 13B.

EXAMPLE 4

The gap on both sides of the green emitting phosphor layer was set to a', and the width of the overlapped portion of the green emitting phosphor and the black light-absorption layer was set to b'. Regarding the other layers, the distances a, b and c were set similarly with Example 1:

The center portion: c=70%, a=10%, 2b=20%
c=70%, a'=10%, 2b'=20%
The peripheral portion: c=50%, a=10%, 2b=40%
c=50%, a=20%, b+b'=30%

Figure 6:
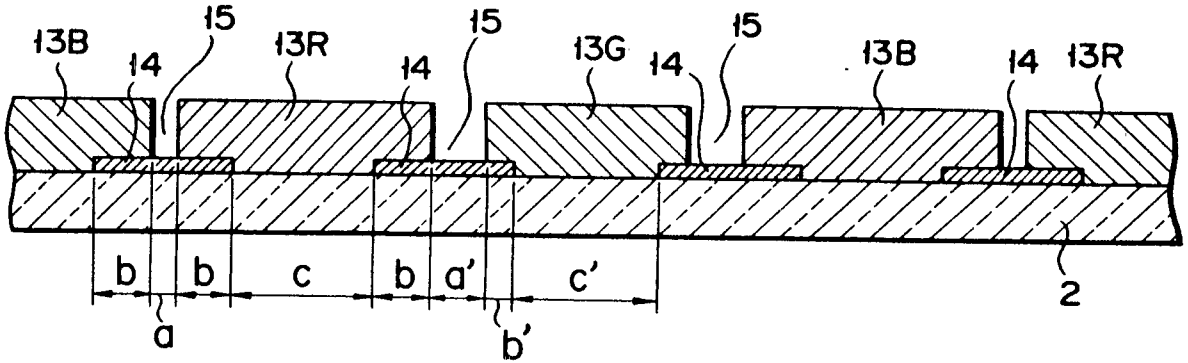

FIG. 6 is a cross-sectional view of the thus obtained phosphor screen. As shown in FIG. 6, a gap a', which is greater than the gap a between the red emitting phosphor layer 13R and the blue emitting phosphor layer 13B, is provided between the green emitting phosphor layer 13G and the red emitting phosphor layer 13R and also between the green emitting phosphor layer 13G and the blue emitting phosphor layer 13B.

Figure 1:
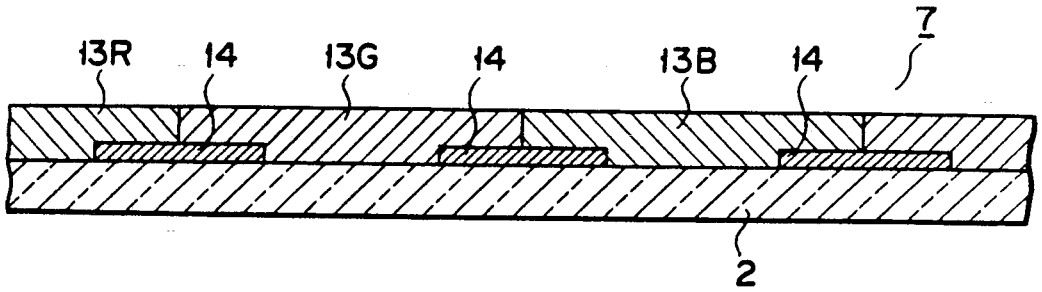
FIG. 1 (PRIOR ART)
FIG. 1 is a cross-sectional view showing an example of a conventional phosphor screen.

In addition, a conventional black stripe type phosphor screen was prepared as Control 1. In control 1, no gap was provided between the phosphor layers 13R, 13G and 13B, as shown in FIG. 1, and the opaque black light-absorption layers 14 were arranged with the value c set to 50%. Another conventional black stripe type phosphor screen was prepared as Control 2, which is similar to Control 1, except that the light transmissivity of each black light-absorption layer was set to 50%.

The white luminance, ambient light reflectance, and landing characteristics allowance were measured with respect to Examples 1 to 4 and Controls 1 and 2. The results are shown in the table shown below. The landing characteristics allowance was measured on the basis of the distance of movement (mm) of the deflecting yoke, within the range of which a single color can be obtained uniformly. The greater the distance of movement, the higher the landing characteristics allowance. The center portion of each phosphor screen has a transverse pitch of 770 μm, a hole size of 180 μm, and a beam diameter of 255 μm. The peripheral portion of each phosphor screen has a transverse pitch of 1080 μm, a hole size of 180 μm, and a beam diameter of 360 μm.

TABLE

| | White Luminance (Peripheral Portion) | Ambient Light Reflectance (Peripheral Portion) | Landing Charateristics Allowance (mm) |
|---|---|---|---|
| Example 1 | 1.4 | 1.18 | 5 |
| Example 2 | 1.2 | 1.11 | 8 |
| Example 3 | 1.48 | 1.22 | 3 |
| Example 4 | 1.34 | 1.17 | 7 |
| Control 1 | 1.5 | 1.25 | 1 |
| Control 2 | 1.0 | 1.00 | 10 |

As is seen from the Table, the phosphor screens of Examples 1 to 4 have excellent values of both white luminance and landing characteristics allowance, whereas the phosphor screens of Controls 1 and 2 have excellent values of only either white luminance or landing characteristics allowance.

The above embodiments were directed only to the black stripe type phosphor screens; however, the above results are applicable also to black matrix type phosphor screens. In Examples 1 to 4, the light transmissivity of each black light-absorption layer was set to 50%. However, in view of the enhancement of luminance, it is desirable that the light transmissivity be set to 20% or more. In addition, in view of the enhancement of contrast, it is desirable that the light transmissivity be set to 70% or less.

The beam diameter is set to be greater than the hole size; otherwise, the luminance is not enhanced. If the beam diameter is less than $\frac{1}{3}$ of the transverse pitch, there is no problem; however, it is more desirable that the beam diameter be set to the width (c+2b) of the phosphor layer. As a matter of course, the light transmissivity may be freely chosen between 20% and 70%, in accordance with the values of a, b and c.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A color picture tube comprising:

a vacuum envelope having a faceplate;

a phosphor screen including semitransparent black light-absorption layers coated on a first region of said faceplate in one of strips and a matrix, and phosphor layers of blue, red and green emitting phosphors coated on a second region of said faceplate in one of stripes and dots; and an electron gun, arranged within the vacuum envelope, for emitting and focusing electron beams, wherein end portions of said phosphor layers extend over the black light-absorption layers, thereby forming overlapped portions, and gaps are provided between the phosphor layers and over the black light-absorption layers;

wherein the light transmittance of each of said black light-absorption layers is set between 20% and 70%; and wherein, when the width a of a portion of each black light-absorption layer, on which no phosphor layer is provided, the width b of the overlapped portion of each black light-absorption layer and each phosphor layer, and the distance c between adjacent ones of the black light-absorption layers have the relationship, $a+2b+c=100\%$, the ratio of a, b and c is set such that $c=40$ to 80%, $a=3$ to 50%, and $2\times b=$ the balance.

2. The color picture tube according to claim 1, wherein said gaps are provided only in the vicinity of the green emitting phosphor layers.

3. The color picture tube according to claim 1, wherein said gaps are provided between those phosphor layers, which are located in the peripheral part of the faceplate.

4. The color picture tube according to claim 1, wherein each of the gap between the green emitting phosphor layer and the red emitting phosphor layer and the gap between the green emitting phosphor layer and the blue emitting phosphor layer is greater than the gap between the red emitting phosphor layer and the blue emitting phosphor layer.

* * * * *